US006382432B1

(12) United States Patent
Hsieh

(10) Patent No.: US 6,382,432 B1
(45) Date of Patent: May 7, 2002

(54) KNOCKDOWN GLASSES SHOW RACK

(76) Inventor: Tzaishu Hsieh, No. 100, Alley 511, Tai-Pin Rd.Ho-Mei Chien, Changhua Hsien (TW)

( * ) Notice: Subject to any disclaimer, the term of this patent is extended or adjusted under 35 U.S.C. 154(b) by 0 days.

(21) Appl. No.: 09/760,766

(22) Filed: Jan. 17, 2001

(51) Int. Cl.[7] ..... A47F 5/00
(52) U.S. Cl. ..... 211/85.1; 211/194; 248/902
(58) Field of Search ..... 211/85.1, 194, 211/189; 248/902

(56) References Cited

U.S. PATENT DOCUMENTS 3,955,681 A * 5/1976 De Zinno ..... 211/85.1 X
4,541,534 A * 9/1985 Strauss ..... 211/194 X
4,592,601 A * 6/1986 Hlinsky et al. ..... 211/194 X
5,176,262 A * 1/1993 Zoueki ..... 211/902 X
5,265,736 A * 11/1993 Orr ..... 211/85.1
D369,039 S * 4/1996 Guccione ..... 248/902 X
5,568,872 A * 10/1996 Hinnant ..... 211/85.1
D393,557 S * 4/1998 Guccione
5,921,409 A * 7/1999 Gerber et al. ..... 211/85.1
6,273,386 B1 * 8/2001 Boeder ..... 248/902 X

* cited by examiner

*Primary Examiner*—Robert W. Gibson, Jr.
(74) *Attorney, Agent, or Firm*—Troxell Law Office PLLC

(57) ABSTRACT

Knockdown glasses show rack including several connecting blocks which are stacked and connected with each other by insertion. The top face of each connecting block is formed with several insertion bosses at equal intervals. The middle of front side of the connecting block is formed with an arch insertion channel with a certain depth. The upper sides of two lateral walls of the insertion channel are formed with arch sockets with an elliptic cross-section. The bottom of the connecting block is formed with a central insertion slot. The connecting blocks can be easily and freely assembled to achieve various patterns of the glasses show rack with more live and beautiful appearance.

3 Claims, 4 Drawing Sheets

KNOCKDOWN GLASSES SHOW RACK

BACKGROUND OF THE INVENTION

The present invention is related to a knockdown glasses show rack composed of multiple connecting blocks which can be freely assembled with each other as personally desired and in accordance with the dimension of the sale site to achieve various patterns and most efficiently utilize the space. The glasses box or the glasses can be fitted with the connecting block so that the glasses show rack can present and highlight the colors of the glasses box or the glasses and thus achieve a more live and beautiful appearance and provide an advertising effect to expedite the consuming desire.

FIG. 1 shows a conventional glasses show rack 10. The glasses show rack 10 includes two side walls and several stages of shelves 11 fixed between the side walls at equal intervals. Multiple glasses A can be arranged on the shelves 11. Such glasses show rack 10 has a considerably large volume and will occupy much room of the sale site. In addition, such glasses show rack 10 has fixed and monotonous pattern and cannot be freely disassembled or changed as necessary to stimulate consuming desire. When it is desired to present another pattern of the glasses show rack 10, it is necessary to add another show rack to the glasses show rack 10 or manufacture a new one. This leads to increased cost.

SUMMARY OF THE INVENTION

It is therefore a primary object of the present invention to provide a knockdown glasses show rack which is composed of multiple connecting blocks which can be freely assembled with each other as personally desired and in accordance with the dimension of the sale site. The glasses show rack can be easily expanded or assembled and disassembled so as to most efficiently utilize the space. In addition, when expanded, it is unnecessary to additionally prepare or manufacture a new show rack so that the cost is saved.

It is a further object of the present invention to provide the above knockdown glasses show rack in which the connecting blocks can be freely assembled to form various kinds of patterns of glasses show rack with more live and beautiful appearance.

It is still a further object of the present invention to provide the above knockdown glasses show rack in which the glasses box or the glasses can be solely fitted in the connecting block or both the glasses box and the glasses can be fitted in the connecting block so that the pattern of the glasses show rack as a whole is changeable. By means of the glasses show rack, the colors of the glasses box and the glasses can be presented and highlighted to achieve an advertising effect and expedite the consuming desire.

The present invention can be best understood through the following description and accompanying drawings wherein:

DETAILED DESCRIPTION OF THE PREFERRED EMBODIMENTS

Figure 1:
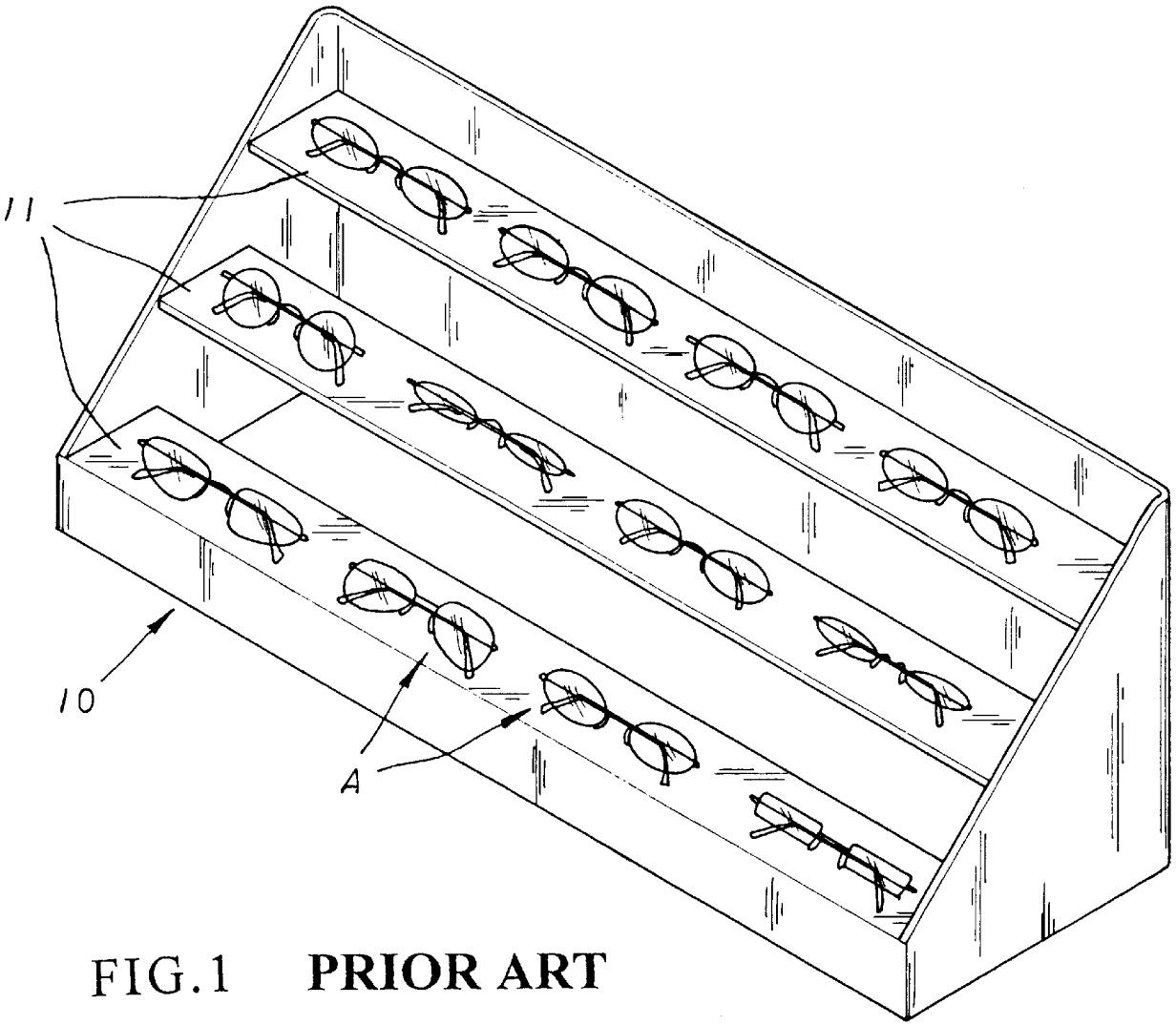
FIG. 1 PRIOR ART
FIG. 1 is a perspective view of a conventional glasses show rack.
Figure 2:
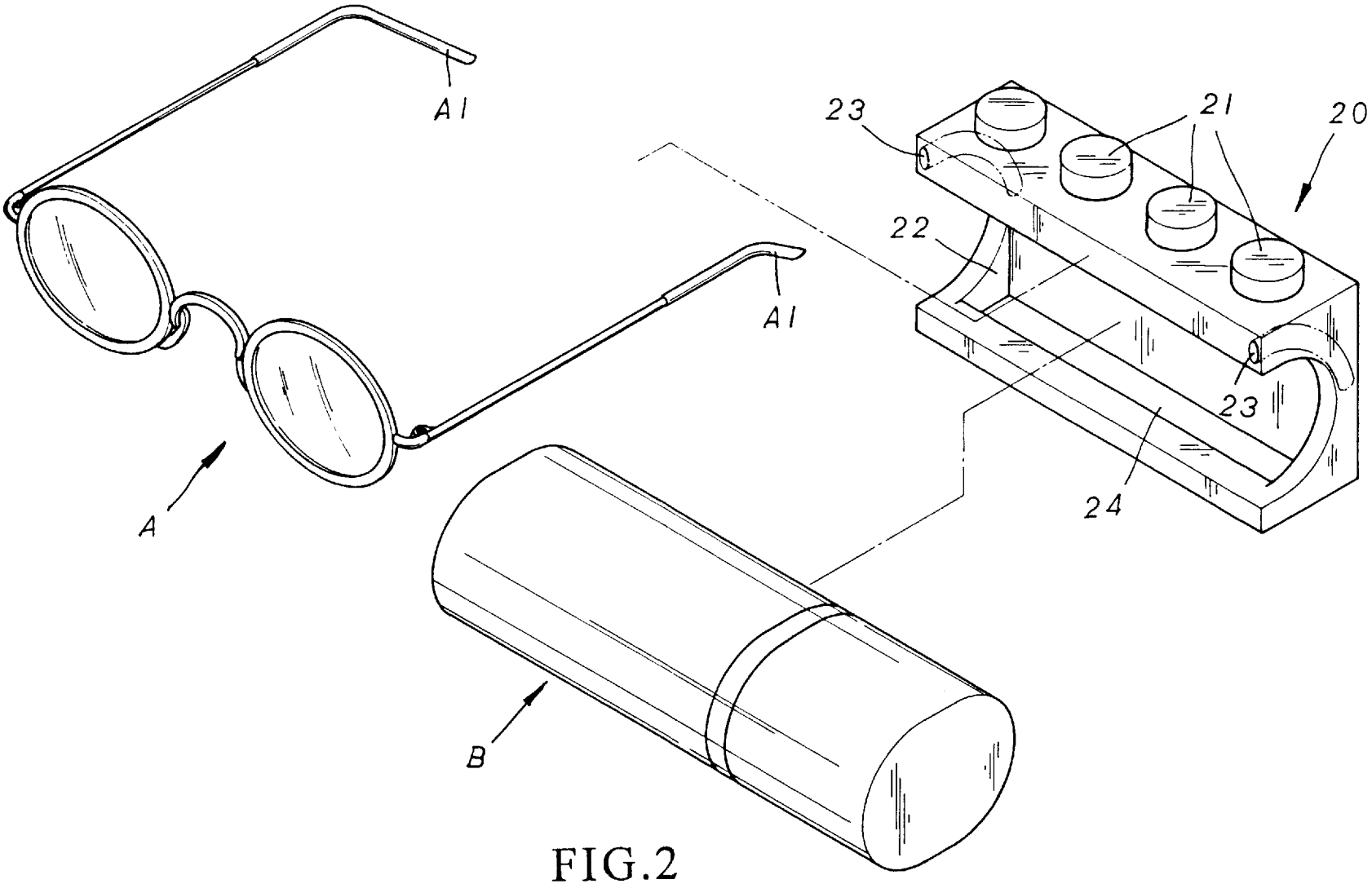
FIG. 2 is a perspective exploded view of the glasses show rack of the present invention.

Please refer to FIG. 2. The glasses show rack of the present invention is composed of several connecting blocks 20 which are stacked and connected with each other by insertion to form various types of patterns. The top face of each connecting block 20 is formed with several insertion bosses 21 at equal intervals. The middle of front side of the connecting block 20 is formed with an arch insertion channel 22 with a certain depth for a glasses box B to fit therein. The upper sides of two lateral walls of the insertion channel 22 are formed with arch sockets 23 with an elliptic cross-section for the temples A1 of the glasses A to insert therein. In addition, the bottom of the connecting block 20 is formed with a central insertion slot 24.

Figure 3:
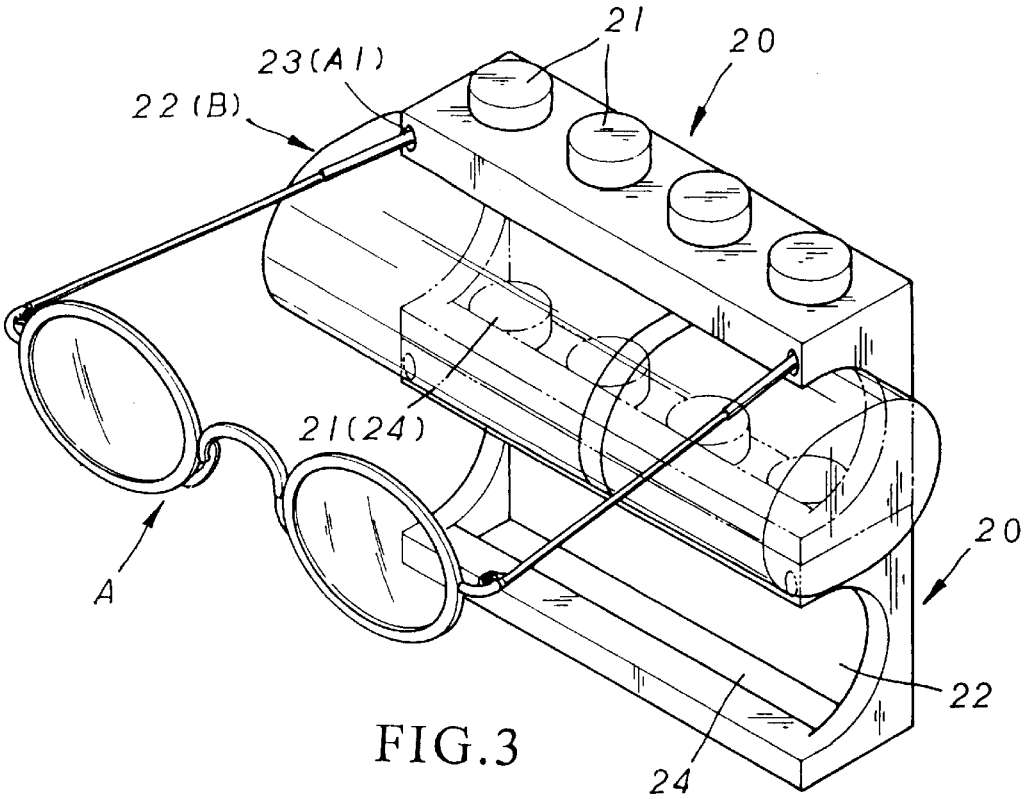
FIG. 3 is a perspective assembled view of the glasses show rack of the present invention.
Figure 4:
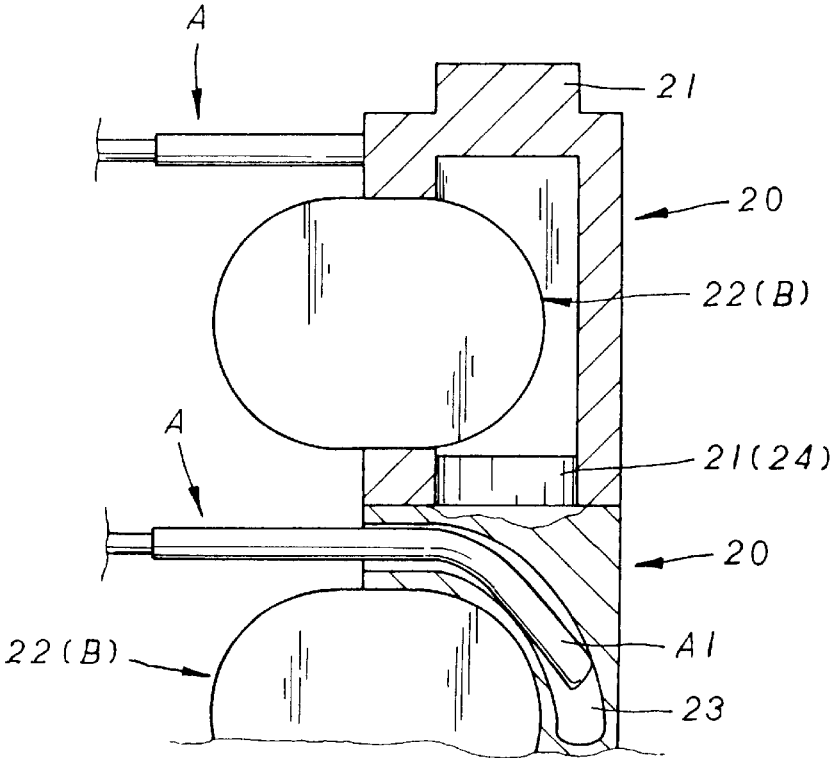
FIG. 4 is a partially section view of the glasses show rack of the present invention.

When assembled, as shown in FIGS. 3 and 4, a connecting block 20 is downward fitted with another connecting block 20 with the insertion bosses 21 of the top face of the lower connecting block 20 totally or partially inserted into the insertion slot 24 of the bottom of the upper connecting block 20. After two connecting blocks 20 are fixed with each other, the glasses box B can be transversely inserted into the insertion channel 22 of front side of the connecting block 22. The temples A1 of the glasses A can be inserted into the sockets 23 of two sides of the connecting block 20 to horizontally support the glasses A thereon for showing the glasses and glasses box.

Figure 5:
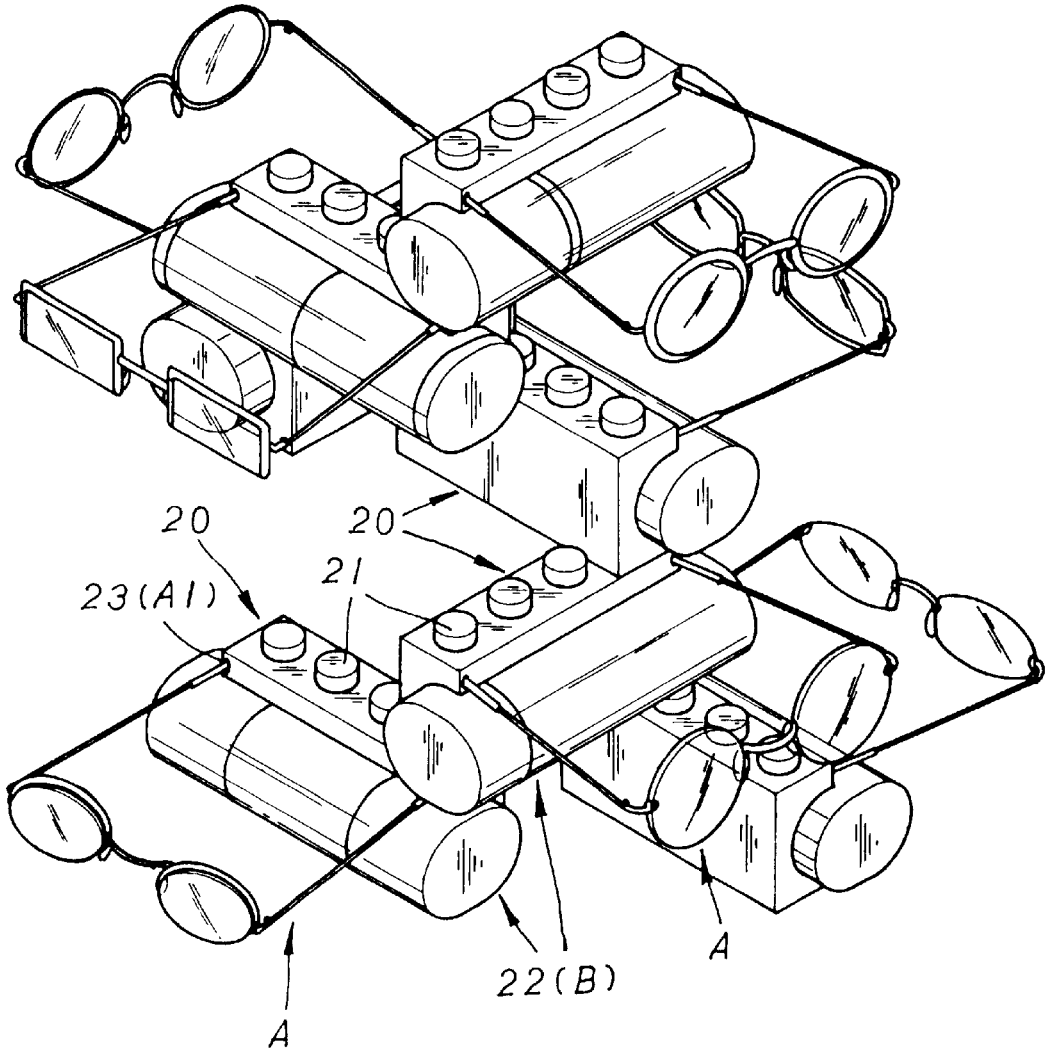
FIG. 5 is a perspective assembled view of the glasses show rack of the present invention, showing the variable pattern thereof.

Referring to FIG. 5, according to the above assembling method, multiple connecting blocks 20 can be stacked and freely assembled by insertion in various directions and positions to form a glasses show rack. The pattern of the glasses show rack can be freely changed as desired.

The present invention has the following advantages:

1. The glasses show rack is composed of multiple connecting blocks 20 which can be freely assembled with each other as personally desired and in accordance with the dimension of the sale site. The glasses show rack can be easily expanded or assembled and disassembled so as to most efficiently utilize the space. In addition, when expanded, it is unnecessary to additionally prepare or manufacture a new show rack so that the cost is saved.
2. The connecting blocks 20 can be freely assembled to form various kinds of patterns of glasses show rack with more live and beautiful appearance.
3. The glasses box B or the glasses A can be solely fitted in the connecting block 20 or both the glasses box B and the glasses A can be fitted in the connecting block 20 so that the pattern of the glasses show rack as a whole is changeable. By means of the glasses show rack, the colors of the glasses box B and the glasses A can be presented and highlighted to achieve an advertising effect and expedite the consuming desire.

The above embodiments are only used to illustrate the present invention, not intended to limit the scope thereof. Many modifications of the above embodiments can be made without departing from the spirit of the present invention.

What is claimed is:

1. A knockdown show rack for eyeglasses comprising a plurality of connecting blocks removably connected together, each connecting block having: an upper surface with a plurality of spaced apart insertion bosses extending outwardly therefrom; a lower surface having a central insertion slot configured to receive at least one of the insertion bosses of another connecting block therein so as to connect the connecting blocks together; an insertion channel between the upper and lower surfaces configured to receive an eyeglass box therein; and, a lateral wall at each of two opposite ends of the insertion channel, each lateral wall having an arch socket therein adapted to receive a temple piece of eyeglasses therein.

2. The knockdown show rack of claim 1 wherein each lateral wall has an arcuate indentation adapted to accommodate an eyeglass box therein.

3. The knockdown show rack of claim 1 wherein the arch sockets of each connecting block are adapted to receive temple pieces of one pair of eyeglasses.

* * * * *